US005560851A

United States Patent [19]

Thimm et al.

[11] Patent Number: 5,560,851

[45] Date of Patent: Oct. 1, 1996

[54] PROCESS FOR PRODUCING CERAMIC HEATING ELEMENTS

[75] Inventors: Alfred Thimm, Wunsiedel; Heinz Groschwitz, Marktredwitz; Peter Besold, Waldershof, all of Germany

[73] Assignee: Hoechst CeramTec Aktiengesellschaft, Selb, Germany

[21] Appl. No.: 338,097

[22] Filed: Nov. 9, 1994

[30] Foreign Application Priority Data

Nov. 11, 1993 [DE] Germany ..... 43 38 539.7

[51] Int. Cl.[6] ..... H05B 3/16; H01C 1/012

[52] U.S. Cl. ..... 219/543; 219/544; 219/552; 338/307

[58] Field of Search ..... 219/543, 544, 219/533, 552, 270; 252/518, 515; 338/307–310, 306

[56] References Cited

U.S. PATENT DOCUMENTS

| | | | |
|---|---|---|---|
| 4,357,526 | 11/1982 | Yomamoto et al. | 219/544 |
| 4,510,000 | 4/1985 | Kumor et al. | 156/89 |
| 4,555,358 | 11/1985 | Matsushita et al. | 252/516 |
| 4,697,165 | 9/1997 | Ishiguro et al. | 338/34 |
| 4,733,056 | 3/1988 | Kojima et al. | 219/543 |
| 4,804,823 | 2/1989 | Okuda et al. | 219/553 |
| 4,818,626 | 4/1989 | Werdecker et al. | 428/469 |
| 4,940,849 | 7/1990 | Morrij et al. | 428/209 |
| 5,021,287 | 6/1991 | Otagiri et al. | 428/212 |
| 5,233,166 | 8/1993 | Maeda et al. | 219/552 |
| 5,236,630 | 8/1993 | Arima et al. | 252/512 |
| 5,264,681 | 11/1993 | Nozaki et al. | 219/544 |

FOREIGN PATENT DOCUMENTS 3538460 4/1986 Germany .

OTHER PUBLICATIONS

Ceramic Bulletin, Otsuka, et al.—"Interfacial Bond Strength In Alumina Ceramics Metallized And Cofired With Tungsten", (1981), pp. 540–545.

*Primary Examiner*—Teresa J. Walberg
*Assistant Examiner*—Sam Paik
*Attorney, Agent, or Firm*—Foley & Lardner

[57] ABSTRACT

A process for producing an electric heating element is disclosed whereby metallic heating conductors are embedded between ceramic insulating layers, and, as power supply leads and power outlet leads, contact recesses in the ceramic insulating layers are filled with an electrically conductive composition. The heating conductors, the power supply leads and the power outlet leads are applied to the ceramic layers in the green state as metallizing paste containing from 60 to 95% by weight of metal particles and from 5 to 40% by weight of inorganic powder, based on the total solids content of the paste. The ceramic layers with the applied metallizing pastes are then stacked on top of one another and then sintered.

15 Claims, 2 Drawing Sheets

1
7
6
8
2
5
2
2
6
7
4
1
1
5
4
1
2
8

PROCESS FOR PRODUCING CERAMIC HEATING ELEMENTS

BACKGROUND OF THE INVENTION

1. Field of the Invention

The invention relates to a process for producing an electric heating element in which metallic heating conductors are embedded between ceramic insulating layers, and, as power supply leads and power outlet leads, contact recesses in the ceramic insulating layers are filled with an electrically conductive composition.

2. Description of Related Art

In CERAMIC BULLETIN 60, p. 540 ff (1981), Otsuka et al. describe how components of ceramic materials containing mostly aluminum oxide or aluminum nitride can be metallized with high-melting metals such as tungsten or molybdenum, how this metallization can then be covered by a further layer of green ceramic and the composite can then be sintered to form the material. The sheet technique is particularly suitable for this purpose.

Components thus produced can be used primarily in the fields of electronics and electrical engineering. Thick-walled and large heating elements are known in various forms. However, with the increasing miniaturization in electronics and electrical engineering, problems occur in production and use.

At high heating power, the materials used have to be resistant to high temperatures without the heating elements being destroyed by overloading (burning through).

Use as heating element is thus possible where the action of an electric current generates large amounts of heat preferentially at those points in the metallization pattern which have a high resistance. Here, in the high-temperature heating range, temperatures can be generated which are so high that use of ceramic materials containing glass phases (glass content >5% by weight) results in flowing of the glass phase in the ceramic. If the distance of a metallic heating strip conductor to the outer surface of the ceramic in the multilayer is here very small, in particular less than 0.4 mm, air can penetrate through the zones depleted in glass phase, i.e. the zones having a particularly high temperature, to the metallic conductor comprising tungsten or molybdenum and destroy this power conductor by oxidation. For this reason it is advantageous to use a ceramic having a low proportion of glass phase.

From Otsuka et al. it is likewise known that metallization pastes without proportions of glass or glass formers have little adhesion to such ceramic materials low in glass phase. It is known that addition of glass can greatly increase the adhesion, but such pastes have a high electrical resistance which is a disadvantage in very fine structures.

SUMMARY OF THE INVENTION

It is an object of the present invention to provide a production process for thin-walled ceramic heating elements in which the structure is first preformed using ceramic sheets and using a metallization resistant to high temperatures and in which sintering of the multilayers structure can then produce a miniaturized high-power heating element having durable long-term stability.

This object is achieved by a process of the generic type mentioned in the introduction whose distinguishing feature is that the heating conductors, the power supply leads and the power outlet leads are applied to the ceramic layers in the green state as metallizing paste containing from 60 to 95% by weight of metal particles and from 5 to 40% by weight of inorganic powder, based on the total solids content of the paste, that the ceramic layers with the applied metallizing pastes are then stacked on top of one another and that sintering is then carried out.

Figure 1:
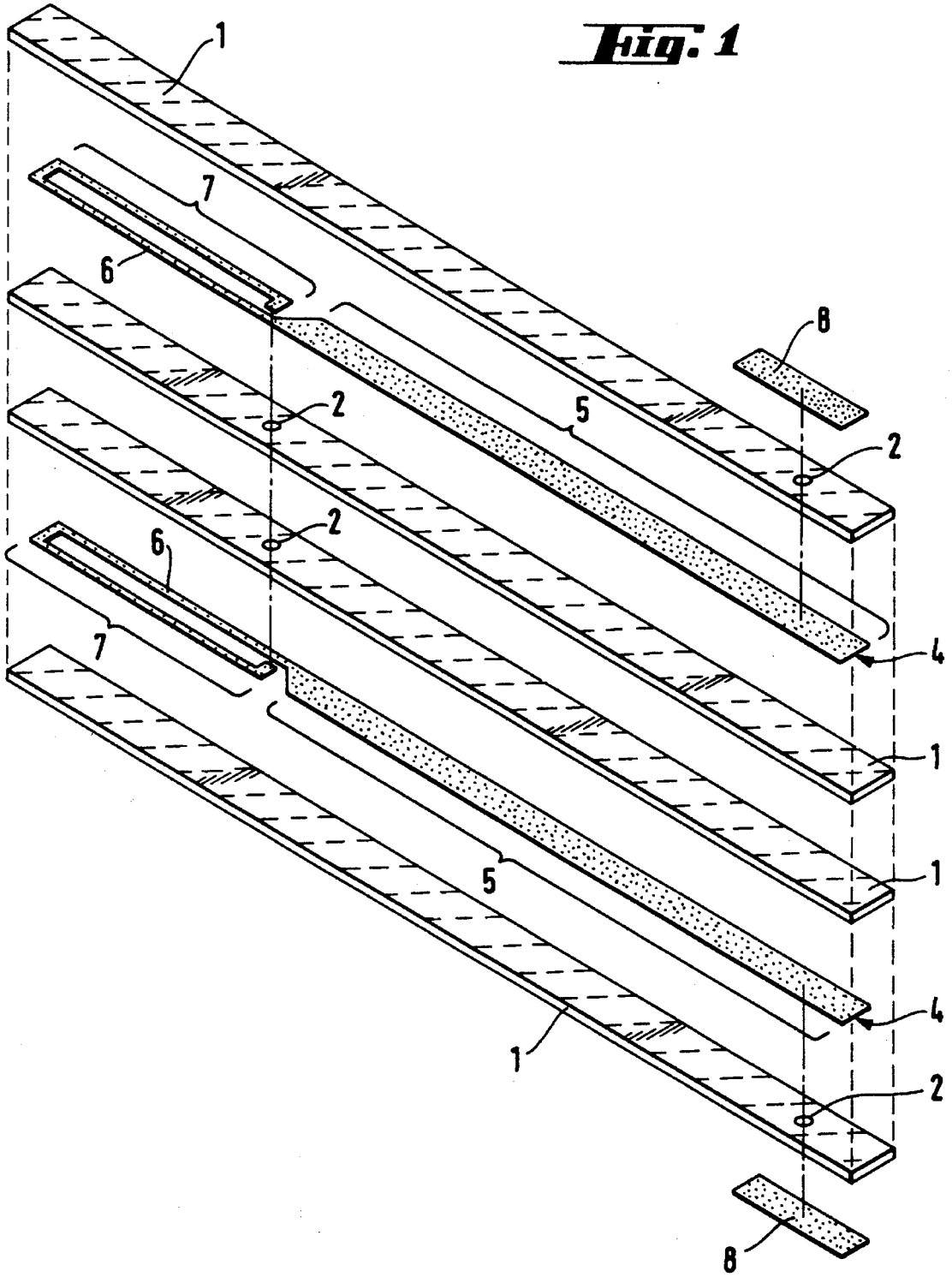
FIG. 1 illustrates a heating element prepared in accordance with Example 1.

In a preferred embodiment of the process of the invention, the metallizing paste resistant to high temperatures is applied by the thick film method. Layers having thicknesses of up to 100 μm are here achieved by the screen printing method. The ceramic insulating layers with the applied metallizing pastes are then preferably first dried. The drying conditions depend on the screen printing oil used, with drying generally being carried out for a period of from 5 to 30 minutes at temperatures in the range from 40° to 150° C.

According to the invention, preference is given to using a metallizing paste which contains at least 70% by weight of metal powder comprising tungsten or molybdenum or mixtures thereof, and at most 30% by weight of a ceramic powder or powder mixture which does not form glass phases and comprises aluminum oxide, aluminum nitride, titanium nitride, titanium carbide or tungsten carbide, and additionally contains from 5 to 35% by weight of an organic pasting medium. Suitable organic pasting media are, in particular, oils such as mineral oil, plant oils or synthetic oils such as screen-printing oil or recycled oil; however, it is also possible to use fats, waxes, additives such as thixotropes, rosin or lecithin to achieve better degrees of filling, bentonites to improve the strength of the unfired paste and/or organic solvents.

To produce the heating element, according to the invention contact recesses, also called "vias" for the purposes of the present invention, are stamped or drilled into unfired ceramic sheets to make possible power transport perpendicular to the sheet surface. The metallizing paste is transferred onto still unfired ceramic sheets by means of a printing process such as screen printing, rotary screen printing, offset printing or dabber printing, with the desired pattern being produced on the sheet surface. The completely filled vias have a diameter of from 0.1 to 0.5 mm, preferably of 0.3 mm. The layer thicknesses of the metallization for the strip conductors can be between 5 and 100 μm, preferably between 10 and 15 μm. The width of the strip conductor should be at least 0.25 mm, for burning through to be avoided with certainty, preferably about 0.5 mm.

To process the paste it is advisable to use the paste for filling the vias at a viscosity of from 150 to 500 Pa·s; in contrast, for the planar metallizing printing, it is advantageous to adjust the paste to a viscosity in the range from 50 to 90 Pa·s by appropriate addition of further small amounts of screen printing oil.

It is advantageous, but not necessary, to use the same metallizing paste for filling the vias and also for the strip conductors and contact surfaces, since then the occurrence of flaws at the interfaces between vias and metallization planes is largely avoided.

The metallization paste is matched to the shrinkage of the sheet in such a way that during sintering there is neither formation of star cracks in the ceramic as a result of too low a shrinkage of the metallization in comparison to the shrinkage of the ceramic, nor formation of voids or star cracks in the via as a result of too high a shrinkage of the metallizing paste. The matching to the shrinkage is achieved by means of the composition and the particle sizes of the powders. The ceramic powder which does not form glass phases present in the metallizing paste preferably has a mean particle size of ≦10 μm, particularly preferably ≦2 μm. The particle sizes are measured using a laser granulometer ®CILAS 850 from ALCATEL.

In addition, a total resistance which is as constant as possible should be set; this resistance is obtained by multiplication of the resistance per unit area of the fired strip conductor and the area of the strip conductor in the plane of the sheet. In practice, total resistances of from about 1 to 1000 ohm are required in such miniature heating elements. The distance between adjacent strip conductors should, if possible, be ≧0.4 mm to avoid burning through. The total arrangement of the strip conductors should be selected in such a way that the loop has as uniform as possible a heating temperature over its whole length. Afterwards, the external metallization sections of the contact surfaces can be electroless nickel plated. For this purpose, use can be made of a commercial metallization bath, for example based on hypophosphite as reducing agent. If required, a copper-containing and/or silver-containing solder layer can additionally be applied.

A plurality of sheets coated with metallizing paste are then stacked on top of one another and pressed together under pressure (usually $\geqq 5 \cdot 10^4$ hPa), if desired in combination with heat (from RT to about 150° C.). To facilitate this process, an adhesion aid comprising an organic mixture with a binder can be applied to the whole surface of the ceramic sheets. Such adhesion aids are known from U.S. Pat. No. 5,021,287 and contain organic resins such as polyvinyl butyral or acrylic resins in an organic solvent and possibly also plasticizers such as phthalic esters or polyethylene glycols.

After a multilayer laminate has been produced, which laminate usually simultaneously contains a plurality of heating elements displaced laterally from one another in the plane, separation into individual pieces has to be carried out, with the future shape of the heating element being produced at the same time. This separation can be carried out, for example, by cutting or stamping.

The final size of the heating element is produced by the sintering process at temperatures ≧1600° C. in a reducing, humid atmosphere. The furnace atmosphere preferably has a composition of about 75% of hydrogen and 25% of nitrogen, with the mixture being saturated with water vapor at a temperature of 55° C.

In particular miniaturization of the heating element, particular attention has to be paid to the temperature distribution and the conducting away of heat. In the heating region, care must be taken to ensure as uniform as possible a layer thickness of the strip conductors to avoid local overheating at constrictions and points having a low layer thickness. Furthermore, poor matching of the geometry and the thermal conductivity of the aluminum oxide material, the composition of the metallization and the configuration of the strip conductors itself leads to burning through as a result of local overheating.

With heating elements which are produced by the process of the invention, continuous use for from 50 to, depending on material composition, 1100 hours can be achieved at temperatures of up to 1800° C. The upper use temperature limit is primarily dependent on the chemical composition of the ceramic insulating layers and the content of phases which soften. Materials such as aluminum oxide, aluminum nitride, zirconium oxide, silicon dioxide or titanium nitride are preferably used for the ceramic insulating layers.

The heating elements can be used as heating elements for oxygen sensors or other measuring probes, in particular for automobile engineering, in laboratory measuring instruments and infrared signal generators or in heating engineering, for example as ignition element for the ignition of outflowing combustible gases or as immersion boiler.

The invention is illustrated by the examples below, without it being limited to the concrete embodiments presented.

EXAMPLE 1

A 0.8 mm thick green sheet contained, besides binder, plasticizer and dispersant, primarily aluminum oxide and 4% of a quartz-containing, glass-forming additive. The sheet was cut with blades to give cards; the recesses for the through contacts (vias) were stamped mechanically. Using screen printing, the vias were filled with a metallizing paste which, besides 84% by weight of tungsten having a mean particle size of 2.5 μm, also contained 16% by weight of a finely divided alumina having a mean particle size of 1 μm and additionally 15% by weight of screen printing oil (based on the weight of the solid component) as organic pasting medium. For processing the paste, a viscosity of 75 Pa·s was set for the planar printing and of 175 Pa·s for the printing of the vias.

After drying the filled vias in air at 70° C., a loop-shaped structure was printed onto the unfired and via-filled cards by the thick-layer method using the paste described and a screen printing machine. The printed cards were dried in air at 70° C. A planar pattern was printed onto other unfired cards by means of a screen printing machine, likewise using the metallizing paste described. These metallization surfaces should lie on the outside in the finished heating element and, as contact areas, make possible electrical connection. All printed cards were dried in air at 70° C.

A plurality of printed cards were then stacked on top of one another in such a way that in each case two cards having a loop pattern have their non-metallized reverse sides in contact and in each case a further card having the connection pattern lies thereon, with the connection pattern in each case facing outwards. A diagrammatic view of this arrangement is shown in FIG. 1. The ceramic sheets 1 having the vias 2 are denoted by reference numbers. The vias 2 are filled with via fillings which are not shown. The metallizations 4 are arranged in such a way that strip conductor supply leads 5 and heating loops 6 result, the latter forming the heating region 7. Finally, the external contact areas 8 can also be seen.

This stack of cards was pressed at a pressure of 90,000 hPa at a temperature of 90° C. A plurality of individual parts were cut from the laminate using a cutting tool. Here, the distance of the loop-shaped structure in the interior of the heating element from the lateral exterior edge of the heating element was 0.5 mm. The bar-shaped heating elements were sintered under protective gas (humid mixture of nitrogen and hydrogen) at a temperature of 1630° C. in a hood type furnace. This produced, on the one hand, the ceramic material aluminum oxide containing 96% by weight of $Al_2O_3$, on the other hand the strip conductors were sintered at the same time in a co-firing process. The completely filled vias had a diameter of 0.3 mm. The layer thickness of the strip conductor metallization was 12 μm and its width was 0.5 mm. The resistance per unit area achieved by means of the strip conductors according to Example 1 was 5 mΩ/cm$^2$. The finished heating bar had both a width and thickness of about 2.5 mm and a length of its heating region of about 18 mm. The measurements carried out on the finished heating element are described after the examples and are tabulated.

COMPARATIVE EXAMPLE 1

In a manner similar to Example 1, a heating element having the same dimensions was produced from the same ceramic material comprising 96% by weight of aluminum oxide and 4% by weight of quartz-containing, glass-forming additive. The only difference was that the metallizing paste comprised 100% by weight of tungsten having an average particle size of 2.5 μm plus the amount of screen printing oil required for processing as paste. Reference is made to the measurement results after the examples.

EXAMPLE 2

The production process for a bar-shaped heating element having a contact area at each of the bar ends and comprising only two layers of ceramic sheet is similar to the production process of Example 1. An aluminum nitride containing 3% by weight of aluminum oxide and 4% by weight of yttrium oxide was prepared as ceramic material. A card made of an unfired ceramic sheet was here printed with a wave- or meander-shaped structure using the metallizing paste described below. Vias were mechanically stamped into a second unfired ceramic card using a metal needle.

The metallizing paste comprised 84% by weight of molybdenum and also 8% by weight of aluminum oxide and further 8% by weight of aluminum nitride. The powders had fine particle sizes as described in Example 1. The metallizing paste was adjusted with screen printing oil to the viscosity described in Example 1.

Figure 2:
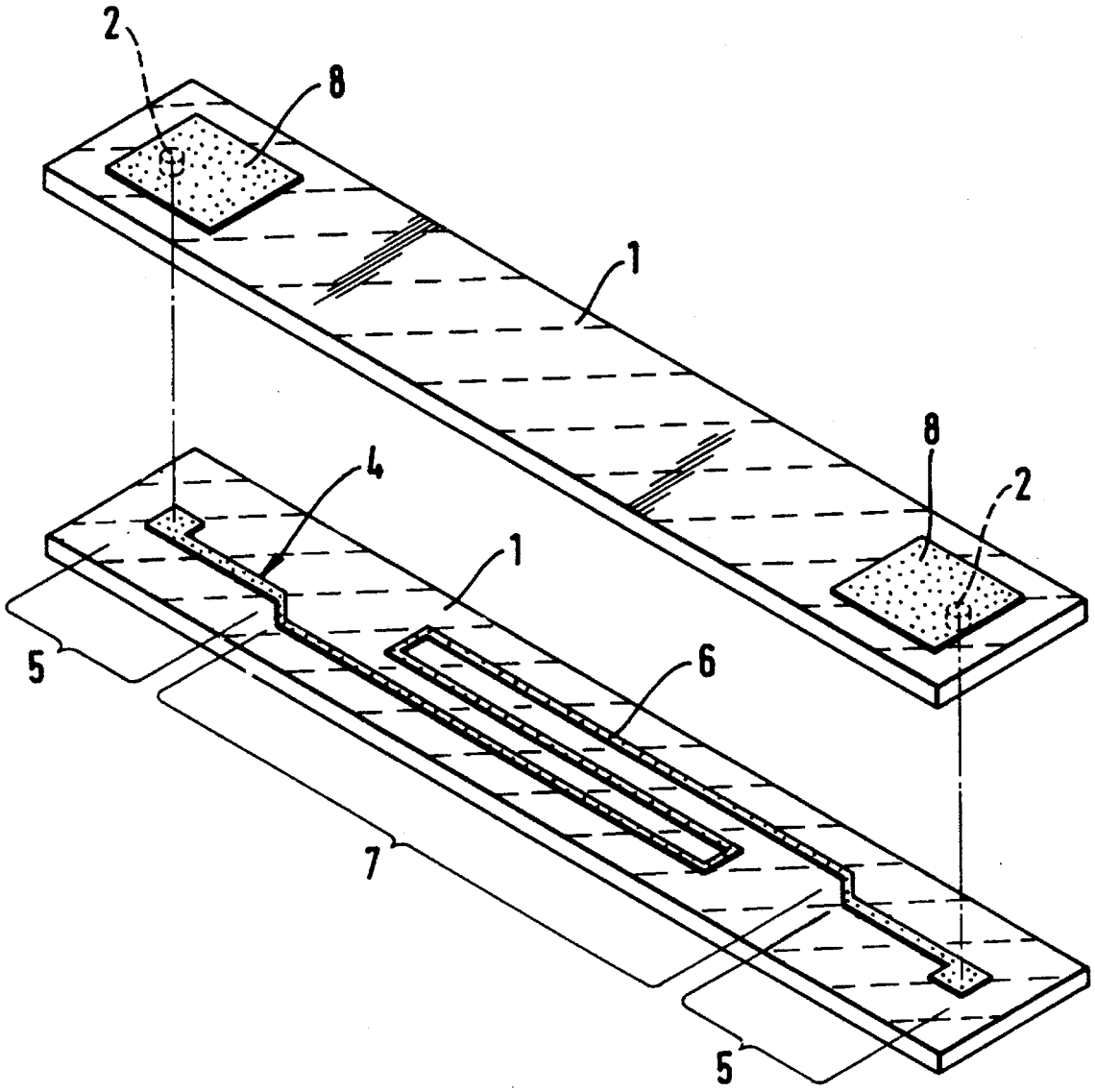
FIG. 2 illustrates a heating element prepared in accordance with Example 2.

The vias were filled with the paste described and dried. A planar or meander-shaped printed pattern was then applied to one side of this card using the paste described and was again dried. Both cards were welded into a water-tight pouch and, by means of an isostatic press, were laminated at a temperature of 70° C. under a high pressure of above 100,000 hPa in such a way that the wave- or meander-shaped structure lies between the two cards, while the contact area faces outwards. Such an arrangement is shown in FIG. 2. The further production process was carried out as described in Example 1.

EXAMPLE 3

The production process for an essentially annular heating element was identical in all respects to the production process of Examples 1 and 2. The ceramic material used was an aluminum nitride containing 10% by weight of aluminum oxide and 3% by weight of yttrium oxide. Cards made of an unfired ceramic sheet were here printed with an essentially annular and, if necessary, wave- or meander-shaped structure using the metallizing paste of Example 2.

If the superposed strip conductors have different shapes or lengths, their electrical resistances and heating temperatures can be matched by means of the cross-section of the strip conductors. The heatable zone can become almost circular by means of a small lengthening of the contact areas and the vias to the outer edge of the component.

To test the loading capacity of the heating elements produced, two different series of measurements were carried out. In the first series, an electrical potential of 17 V was applied to the contacts of the heating elements while the heating element was heated in a furnace at a constant temperature of 1000° C. The current flowing through the heating element self-adjusts and is indicated by an ammeter. However, the test measures only the time which elapses until the meter indicates a current of 0 A because the element is then defective.

In the second measurement, a so-called overloading test is carried out. Here, an electrical potential of 30 V is applied to the heating element, with in this case current and temperature becoming freely established. In this case too, the measurement is of the time which elapses until the heating element is burnt through and 0 A is indicated as a result. The results are summarized in the table below:

TABLE

| Example No. | 1 | 2 | 3 | V 1*) |
|---|---|---|---|---|
| 17 V/1000° C. | 199 h+) | 212 h | 148 h | 25 h |
| 30 V | 34 m#) | 69 m | 28 m | 12 m |

*)Comparative Example 1
+)h = hours
#)m = minutes

I claim:

1. A process for preparing an electric heating element which comprises metallic heating conductors embedded between a plurality of ceramic insulating layers and contact recesses in the ceramic insulating layers filled with an electrically conductive composition as power supply and power outlet leads, said process comprising the steps of:

(a) applying said heating conductors and said electrically conductive composition to said ceramic insulating layers in a green state as a metallizing paste comprising from 60 to 95% by weight of metal particles and from 5 to 40% by weight of an inorganic powder, each based on the total solids content of said paste;

(b) stacking said ceramic insulating layers with said applied metallizing paste on top of one another; and (c) sintering said stacked ceramic insulating layers, whereby said ceramic insulating layers and said metallizing paste are selected to reduce the formation of voids or cracks in said ceramic insulating layers and in said contact recesses during sintering, and wherein the viscosity of said metallizing paste used for filling said contact recesses is adjusted to a value in the range from 150 to 500 Pa·s and wherein the viscosity of said metallizing paste used for said heating conductors is adjusted to a value in the range from 50 to 90 Pa·s.

2. The process as claimed in claim 1, wherein said metallizing paste is resistant to high temperatures and is applied by a thick-film method.

3. The process as claimed in claim 1, wherein said ceramic insulating layers together with said applied metallizing pastes are dried at temperatures of from 40° to 150° C. before the stacking and sintering step.

4. The process as claimed in claim 1, wherein said metallizing paste comprises at least 70% by weight of metal powder selected from the group comprising tungsten and molybdenum or mixtures thereof, and at most 30% by weight of a ceramic powder or powder mixture which does not form glass phases and comprises aluminum oxide, aluminum nitride, titanium nitride, titanium carbide or tungsten carbide.

5. The process as claimed in claim 1, wherein said metallizing paste comprises additionally from 5 to 35% by weight of an organic pasting medium, calculated on the total solids content of said metallizing paste.

6. The process as claimed in claim 1, wherein said metallizing paste is transferred onto said still unfired ceramic layers by means of a printing process such as screen printing, rotary screen printing, offset printing or dabber printing, with a desired pattern being produced on said layers surface, wherein said contact recesses have a diameter of from 0.1 to 0.5 mm, wherein the layer thicknesses of said metallization for said heating conductors is between 5 and 100 μm and wherein the width of said heating conductors is at least 0.25 mm.

7. The process as claimed in claim 6, wherein said contact recesses have a diameter of 0.3 mm, wherein the layer thicknesses of said metallization for said heating conductors is between 10 and 25 μm and wherein the width of said heating conductors is at least 0.5 mm.

8. The process as claimed in claim 4, wherein said ceramic powder which does not form glass phases has a mean particle size of ≦10 μm.

9. The process as claimed in claim 8, wherein said ceramic powder has a mean particle size of ≦3 μm.

10. The process as claimed in claim 1, wherein said sintering step is carried out at a temperature of ≧1600° C. in a reducing, humid atmosphere.

11. An electric heating element produced by a process as claimed in claim 1, having a constant total resistance in the range of from 1 to 1000 Ω, said total resistance representing the total resistance of the heating conductor and being obtained by multiplication of a resistance per unit area of the fired heating conductor and an area of the heating conductor in a plane of said ceramic layer.

12. The electric heating element as claimed in claim 11, having electroless nickel plated external metallization sections as contact areas.

13. The electric heating element as claimed in claim 12, wherein a copper-containing silver-containing solder layer is additionally applied to said contact areas.

14. A method for ignition of outflowing combustible gases comprising using a heating element as claimed in claim 11 as an ignition element.

15. A method of making a gas sensor comprising combining a gas sensor with a heating element as claimed in claim 11.

* * * * *